US007737808B2

(12) United States Patent
Huang et al.

(10) Patent No.: US 7,737,808 B2
(45) Date of Patent: Jun. 15, 2010

(54) RESONANT FREQUENCY SHIFTED CONNECTOR

(75) Inventors: Ching-Chao Huang, San Jose, CA (US); Gong-Jong Yeh, San Jose, CA (US); Clement Kam Lam Luk, San Jose, CA (US); Tatsuya Arai, Los Altos, CA (US)

(73) Assignee: Hirose Electric, Cupertino, CA (US)

( * ) Notice: Subject to any disclaimer, the term of this patent is extended or adjusted under 35 U.S.C. 154(b) by 184 days.

(21) Appl. No.: 12/194,542

(22) Filed: Aug. 20, 2008

(65) Prior Publication Data

US 2010/0045408 A1 Feb. 25, 2010

(51) Int. Cl.
*H01P 1/00* (2006.01)

(52) U.S. Cl. ..... 333/260; 333/245; 439/607.07

(58) Field of Classification Search ..... 439/607.07, 439/607.06, 607.05, 607.09, 607.1; 333/32, 333/33, 245, 260, 246
See application file for complete search history.

(56) References Cited

U.S. PATENT DOCUMENTS 6,652,319 B1 * 11/2003 Billman ..... 439/607.07
7,371,117 B2 5/2008 Gailus

OTHER PUBLICATIONS

Sarfaraz, Ali et al., "Interconnect Characterization and Design Optimization for High Speed Digital Applications," IEEE Conference on Electrical Performance on Packaging, 2000, pp. 177-180.

* cited by examiner

*Primary Examiner*—Stephen E Jones
(74) *Attorney, Agent, or Firm*—Victor H. Okumoto

(57) ABSTRACT

A connector has data signal conductors for communicating data signals and voltage reference (power and ground) conductors for the signals' return currents. Voltage reference conductors carrying the same voltage level are coupled together at one or more points between the ends of the connector to shift the connector's resonant frequency beyond an operating frequency range of the data signals. Decoupling capacitors may alternatively or additionally be inserted between pairs of voltage reference conductors carrying high and low voltage levels at one or more points between the ends of the connector to shift the connector's resonant frequency beyond an operating frequency range of the data signals.

13 Claims, 7 Drawing Sheets

RESONANT FREQUENCY SHIFTED CONNECTOR

FIELD OF THE INVENTION

The present invention generally relates to connectors for electrically communicating data between electronic devices and in particular, to a connector modified so as to shift its resonant frequency beyond an operating frequency range of data signals electrically communicated by the connector.

BACKGROUND OF THE INVENTION

The primary function of an electrical connector is to provide electrical connection from one electronic device to another so that data signals may be electrically communicated between the two devices. In an ideal situation, a data signal that exits the connector at one end of the connector should be free of distortion and resemble the data signal as it enters the connector at the other end.

FIG. 1 illustrates a lengthwise cross-sectional view of one example of a connector 100 which has two lengthwise extending structures 201, 211 upon each of which a reference voltage conductor is provided on one side and a pair of data signal conductors is provided on the other side. Although only two such structures 201, 211 are shown, it is to be appreciated that many more of such lengthwise extending structures may be provided in the connector 100 to accommodate more data signal conductors.

The data signal conductors are used to transmit data signals from one end of the connector 100 to the other. The reference voltage conductors (i.e., power and ground) provide current return paths for the data signals transmitted through the data signal conductors. Outside the connector 100, such as on printed circuit boards 111 and 112 to which the connector 100 has been connected, all of the high reference voltage conductors of the same voltage level are connected to a common high voltage reference (e.g., power) and all of the low reference voltage conductors are connected to a common low voltage reference (e.g., ground).

FIGS. 2*a* and 2*b* respectively illustrate simplified top and bottom views of the lengthwise extending structure 201. As shown in FIG. 2*a*, the structure 201 has a voltage reference conductor 202 that covers most of one large area side of the structure 201 and as shown in FIG. 2*b*, the structure 201 has a pair of data signal conductors 203, 204 extending lengthwise on the opposite large area side of the structure 201. Although only two data signal conductors 203, 204 are shown on one side of the structure 201 in this example, more than two data signal conductors may also be provided. The second lengthwise extending structure 211 is similarly constructed as the first structure 201. The structures 201, 211 are generally non-conductive supporting structures that are separated, as shown in their respectively lengthwise and widthwise cross-sectional views in FIGS. 3*a* and 3*b*, by an air gap or non-conductive filler material 280 (such as a plastic).

Referring back to FIG. 1, the connector 100 is a two-part connector having a first part 101 connected to a first printed circuit board 111 and a second part 102 connected to a second printed circuit board 112. This two-part structure is advantageous, for example, because it facilitates wave-soldering the first and second parts 101, 102 respectively to the first and second printed circuit boards 111, 112. For example, as shown in FIG. 1, leads on the first part 101 that are connected to the voltage reference conductors 202, 212 and data signal conductors 203, 204, 213, 214 are soldered to the printed circuit board 111; and mating structures on the second part 102 are soldered to the printed circuit board 112. To subsequently connect the first and second printed circuit boards 111, 112 together so that data signals may be transmitted from one to the other, the first and second parts 101, 102 of the connector 100 are mechanically mated together. In particular, edges 205, 215 of the lengthwise extending structures 201, 211 serve as male members on the first part 101 that press fit into pairs of opposing clips (acting as mating structures) provided on the second part 102.

More particularly, to mate with edge 205 of the structure 201, a clip 252 makes physical and electrical connection with the voltage reference conductor 202 and its opposing clip 253 makes physical and electrical connection with the data signal conductor 203 so that the opposing clips 252, 253 apply a holding force to the edge 205 of the structure 201. Another pair of opposing clips (occluded from view and not shown in FIG. 1) is also provided wherein one of the clips makes physical and electrical connection with the voltage reference conductor 202 and the other of the clips makes physical and electrical connection with the data signal conductor 204 so that the opposing clips also apply a holding force to the edge 205 of the structure 201.

Likewise, to mate with edge 215 of the structure 211, a clip 262 makes physical and electrical connection with the voltage reference conductor 212 and its opposing clip 263 makes physical and electrical connection with the data signal conductor 213 so that the opposing clips 262, 263 apply a holding force to the edge 215 of the structure 211. Another pair of opposing clips (occluded from view and not shown) is also provided wherein one of the clips makes physical and electrical connection with the voltage reference conductor 212 and the other of the clips makes physical and electrical connection with the data signal conductor 213 so that the opposing clips also apply a holding force to the edge 215 of the structure 211.

It is known that when the length of the connector 100 is a multiple of one half the wavelength of the data signals passing through the data signal conductors of the connector 100, then the frequency of the data signals is at a resonant frequency. At or near the resonance, the insertion-loss-to-crosstalk ratio (ICR), a key parameter for determining the connector's performance, is significantly degraded. Thus, if the resonant frequency falls within or near the operating frequency range of data signals being communicated by the connector 100, the performance of the connector 100 may be significantly degraded.

OBJECTS AND SUMMARY OF THE INVENTION

We have found that resonance will significantly degrade the performance of an electrical connector when the following hold true: (1) there exists more than one ground conductor (or more than one power conductor) in the connector, and (2) the distance between the two nearest points where the more than one ground conductors are connected (or the more than one power conductors are connected) is a non-zero integer multiple of one-half the wavelength (i.e., $n\lambda/2$, where "n" is the non-zero integer multiple and "$\lambda$" is the wavelength) of the frequency of data signals being communicated through the connector. Since the connection points are usually outside the connector, the distance between the two nearest connection points is approximately the length of the connector.

Accordingly, one object of one or more aspects of the present invention is a modified connector whose resonant frequency has been shifted so that it falls beyond an operating frequency range of data signals being communicated by the connector.

Another object of one or more aspects of the present invention is a modified connector having the previously stated characteristics that is easy to manufacture with minimal changes to the base design.

Still another object of one or more aspects of the present invention is a modified connector having the previously stated characteristics that exhibits improved insertion loss, return loss, near-end crosstalk, and far-end crosstalk characteristics over its operating frequency range.

These and other objects are accomplished by the various aspects of the present invention, wherein briefly stated, one aspect is a method for modifying a connector so as to shift its resonant frequency beyond an operating frequency range of data signals electrically communicated by the connector, wherein a distance between opposing ends of the connector is approximately an integer multiple of one-half of a wavelength of a frequency of the data signals, the method comprising: electrically coupling together a plurality of voltage reference conductors at one or more points between opposing ends of the connector.

Other aspects of the invention include an improvement to a connector having first and second ends. The connector has data signal conductors which extend between and are coupled to the first and second ends so as to electrically communicate data signals between the first and second ends, wherein a distance between the first and second ends is approximately an integer multiple of one-half of a wavelength of a frequency of the data signals being communicated. It also has voltage reference conductors which extend between and are coupled to the first and second ends so as to electrically communicate voltage references between the first and second ends (thereby providing current return paths for the data signals). The voltage reference may indicate power (high) or ground (low). In the improvement to the connector, at least one conductive element is attached to the voltage reference conductors at point(s) between the first and second ends so as to shift the resonant frequency of the connector beyond the operating frequency range of the data signals.

Additional objects, features and advantages of the various aspects of the present invention will become apparent from the following description of its preferred embodiment, which description should be taken in conjunction with the accompanying drawings.

DETAILED DESCRIPTION OF THE PREFERRED EMBODIMENT

Figure 1:
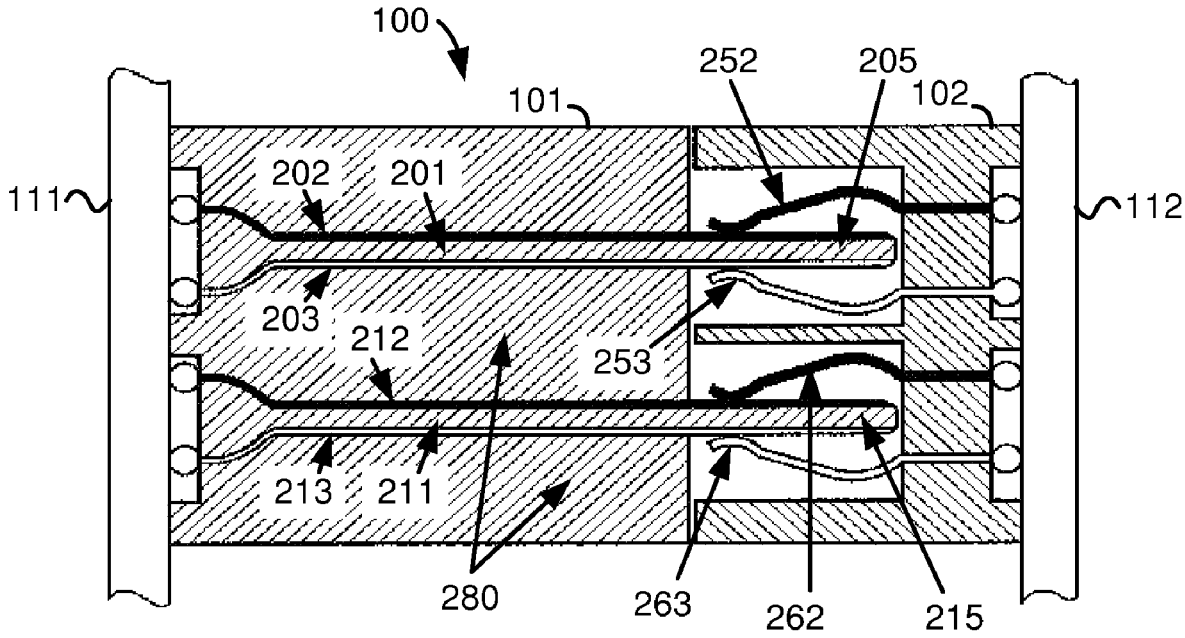
fig.1 prior art
FIG. 1 illustrates a lengthwise cross-sectional view of a connector.
Figure 2A:
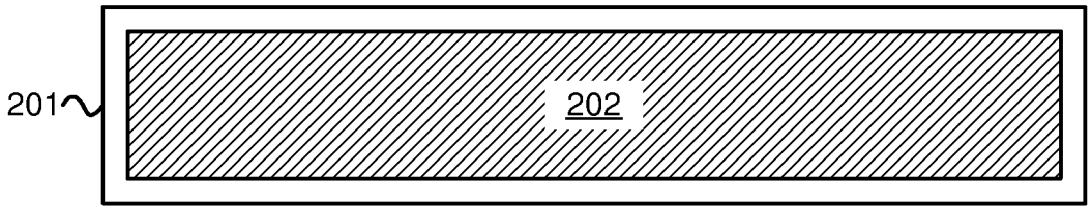
fig.2a prior art
FIGS. 2*a*-2*b* illustrate top and bottom views of one of the lengthwise extending structures of FIG. 1.
Figure 2B:
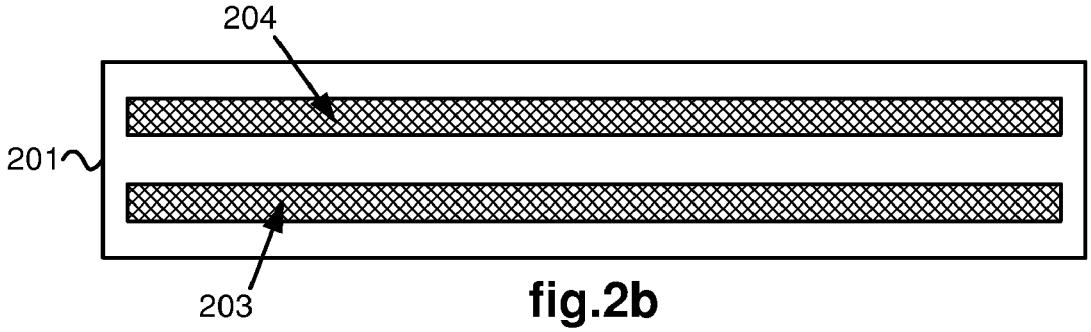
fig.2b prior art
Figure 3A:
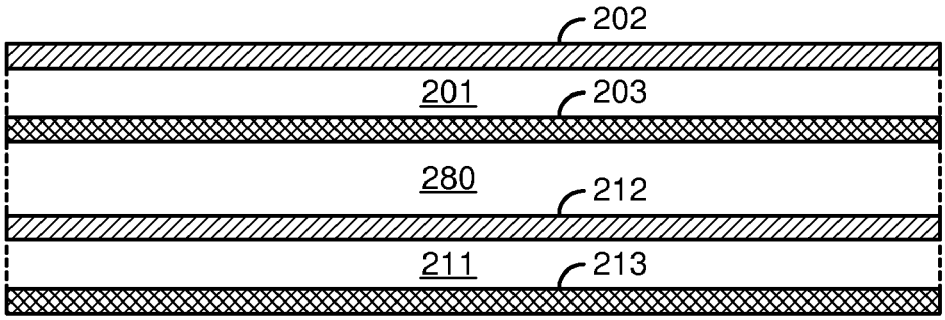
fig.3a prior art
FIGS. 3*a*-3*b* illustrate lengthwise and widthwise cross-sectional views of a portion of the connector illustrated in FIG. 1.
Figure 3B:
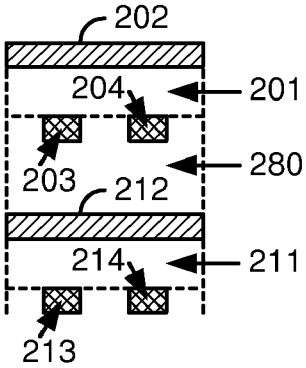
fig.3b prior art

A conventional connector, such as the connector 100 of FIG. 1, may have degraded performance if it has a resonant frequency that is within or near the operating frequency range of data signals being electrically communicated through the connector with other devices. Such a situation has been found to occur when the minimum distance between connecting points on either the power or ground conductors is a non-zero integer multiple of one-half the wavelength of a frequency of the data signals.

Therefore, in order to shift the resonant frequency above the frequency of the data signals being communicated through the connector, one or more of the following modifications to the connector may be implemented: power conductors of the same voltage level are tied-down (i.e., shorted together) at distances between adjacent tie-downs or other common connections that are less than one-half the wavelength of an operating frequency; ground conductors are tied-down at distances between adjacent tie-downs or other common connections that are less than one-half the wavelength of an operating frequency; and/or capacitors are placed between pairs of high and low reference voltage conductors at distances between adjacent of such decoupling capacitors or other common connections that are less than one-half the wavelength of an operating frequency.

Figure 4:
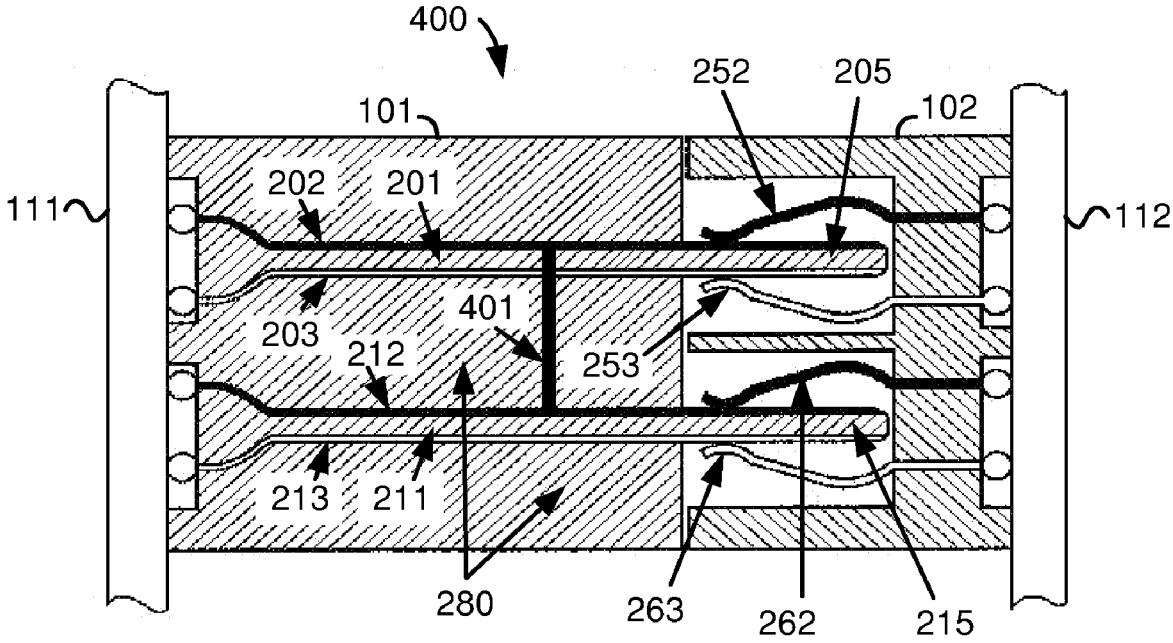
FIG. 4 illustrates a lengthwise cross-sectional view of the connector of FIG. 1 as modified according to a first embodiment utilizing aspects of the present invention.

FIG. 4 illustrates a lengthwise cross-sectional view of one example of how the connector 100 may be modified to form a modified connector 400, where the two voltage reference conductors 202, 212 are connected together by a conductive element 401 that may be either a conducting strip or a decoupling capacitor at a mid-point between opposing ends of the connector 400. A widthwise cross-sectional view of a portion of the connector 400 is shown in FIG. 5.

Figure 5:
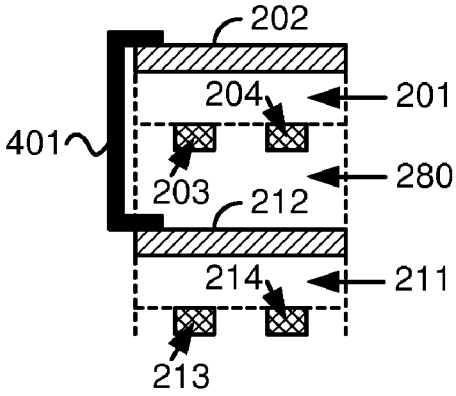
FIG. 5 illustrates a widthwise cross-sectional view of a portion of the connector of FIG. 4 showing the coupling of adjacent voltage reference conductors.
Figure 6:
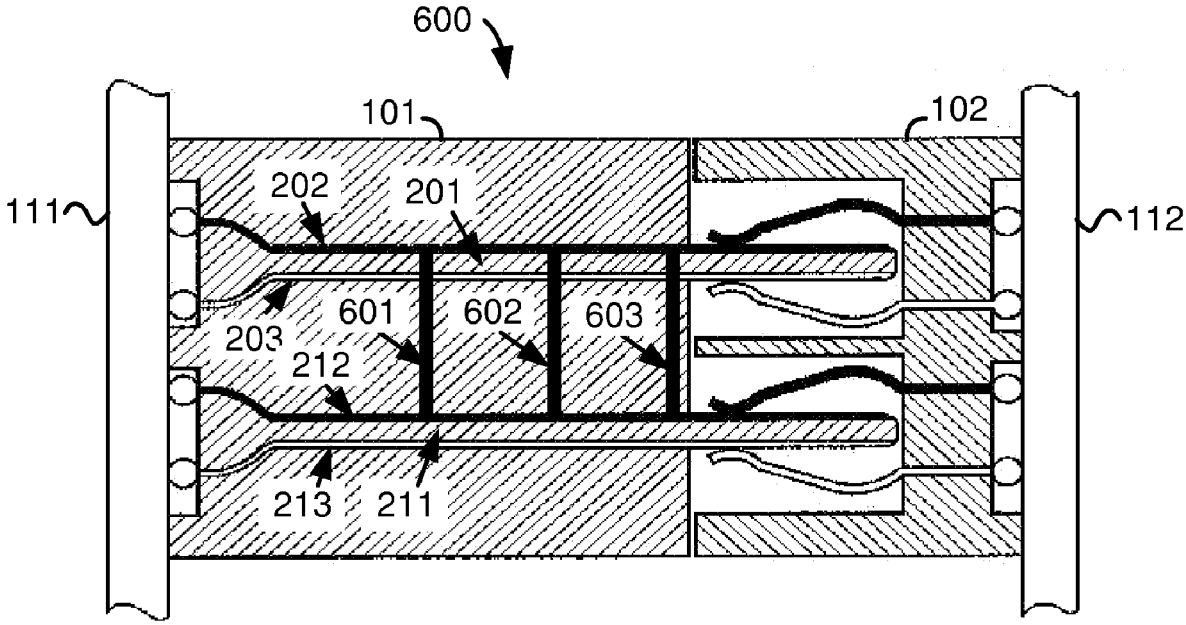
FIG. 6 illustrates a lengthwise cross-sectional view of the connector of FIG. 1 as modified according to a second embodiment utilizing aspects of the present invention.
Figure 7:
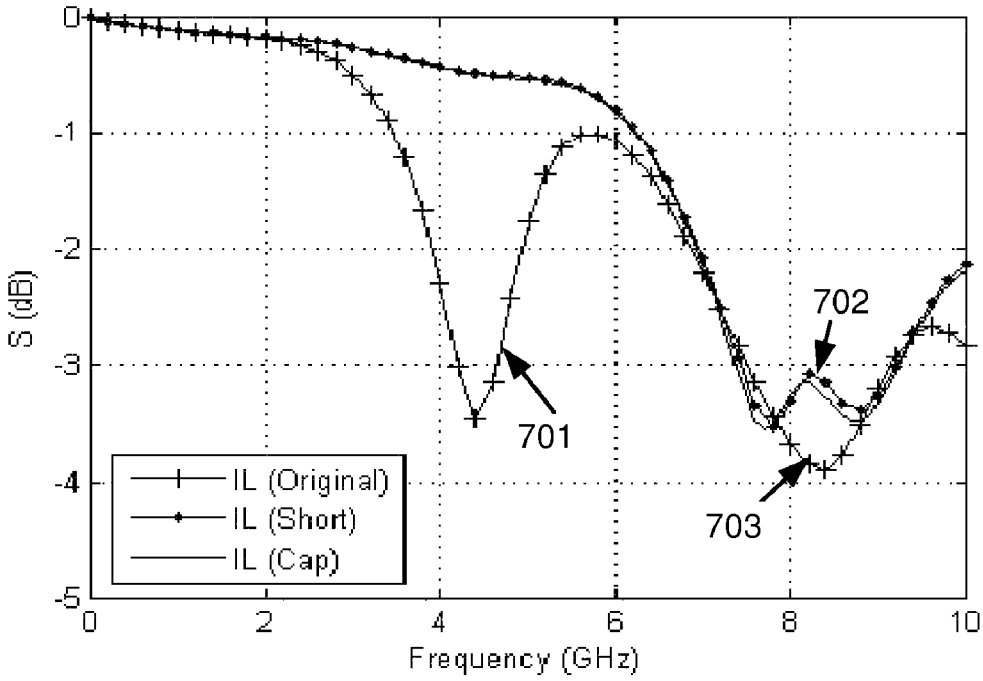
FIGS. 7-10 respectively illustrate simulated insertion loss, return loss, near-end crosstalk, and far-end crosstalk characteristics for the unmodified connector and two modified connectors according to aspects of the present invention.
Figure 8:
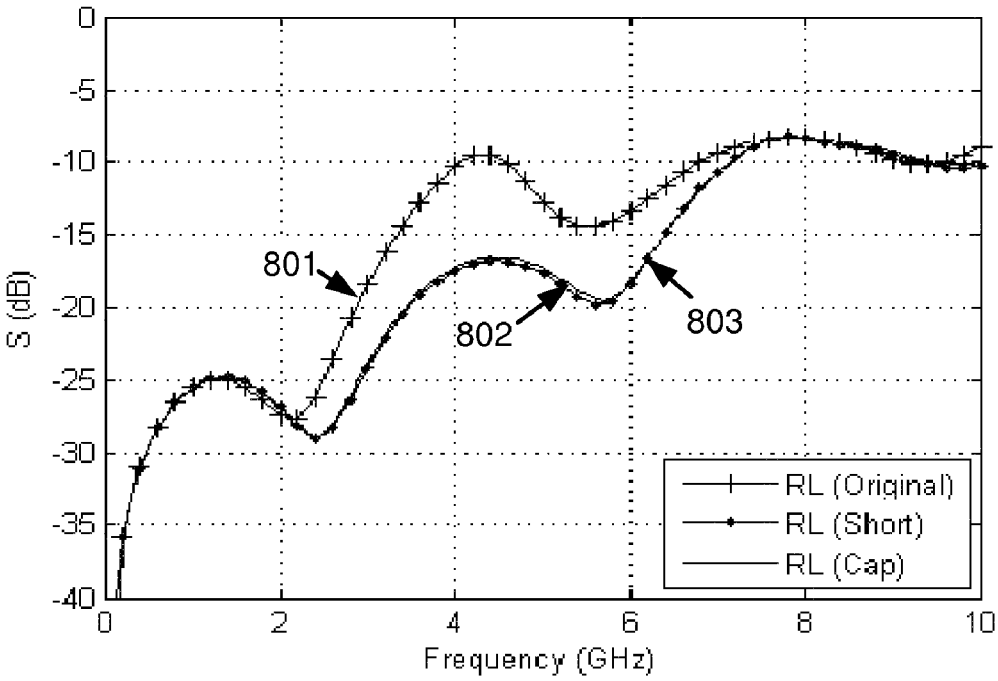
Figure 9:
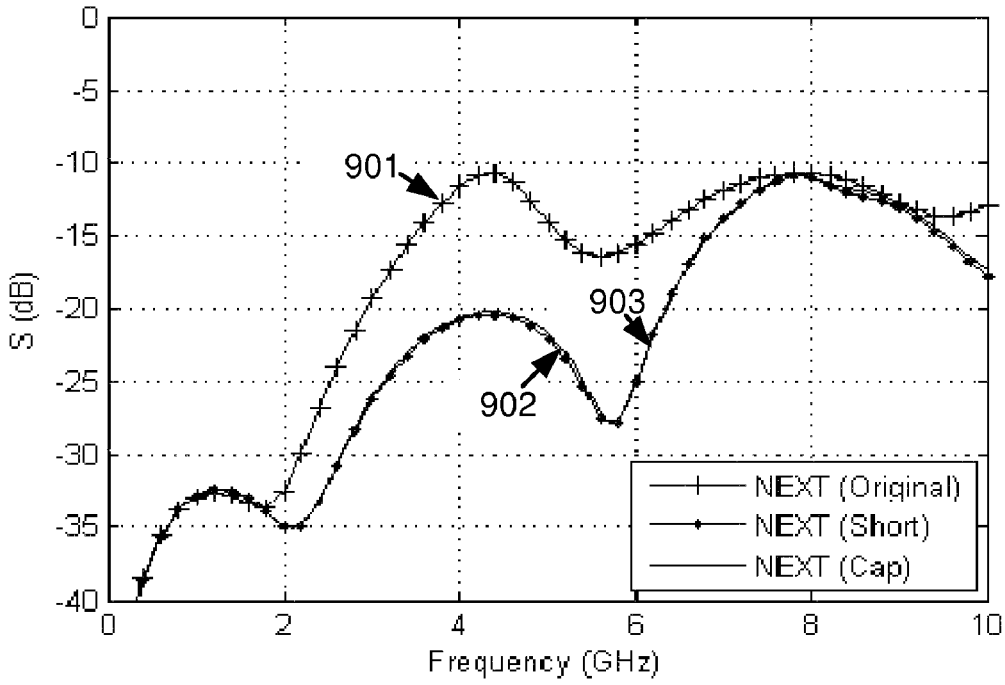
Figure 10:
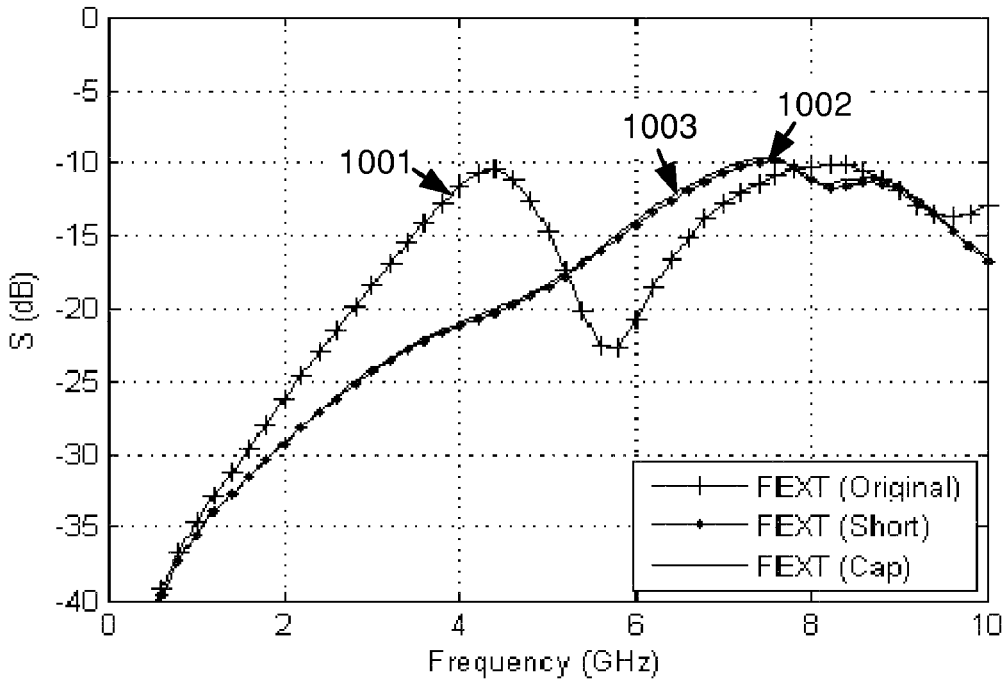

Although only one conductive element 401 is shown in FIGS. 4-5, more conductive elements may also be used to shift the resonant frequency of the connector 400 beyond the operating frequency range of data signals being communicated through its data signal conductors. For example, FIG. 6 illustrates a lengthwise cross-sectional view of another example of how the connector 100 may be modified to form a modified connector 600, where the two voltage reference conductors 202, 212 are connected together by a plurality of conductive elements 601-603 that may be either conducting strips or decoupling capacitors at spaced apart points between opposing ends of the connector 600. Note that for very high frequency data signals, such a multiple conductive element structure may be desirable to ensure that the distance between each adjacent pair of conductive elements is less than one-half the wavelength of a frequency of the data signals.

FIGS. 7-10 respectively illustrate the simulated insertion loss (IL), return loss (RL), near-end crosstalk (NEXT), and far-end crosstalk (FEXT) frequency responses for the data signal conductors 203, 204 of the original connector 100 (i.e., responses 701, 801, 901, 1001); the modified connector 400 with a shorting conductive element coupling same voltage reference level conductors at a mid-way point (i.e., responses 702, 802, 902, 1002 with reference voltage conductors 202, 212 assumed to be at the same voltage reference level); and the modified connector 400 with a decoupling capacitor element coupled at a mid-way point to pairs of high and low voltage reference level conductors (i.e., responses 703, 803, 903, 1003 with reference voltage conductors 202, 212 assumed to be at different voltage reference levels) for comparison purposes. For the purposes of these simulations, the lengths of the data signal conductors 203, 204 are assumed to be 26 mm, the pitch between structures 201, 211 is assumed to be 1.75 mm, and the decoupling capacitor element is assumed to have a value of 1 nF.

In reviewing the figures, the resonant frequency at 4.4 GHz for the original connector 100 is shown to be shifted to a higher resonant frequency of 8.4 GHz for both the modified connector 400 with the shorting conductive element and the modified connector 400 with the decoupling capacitor element. From these figures, it is apparent that either an electrical short can be used that connects voltage reference conductors of the same voltage level together (e.g., power to power or ground to ground) or a capacitive device can be used that connects voltage reference conductors of different voltage levels together (e.g., power to ground). In those connectors that do not have pre-assigned power and ground conductors, capacitive device(s) may be preferable during connector assembly for practical applications.

Figure 11:
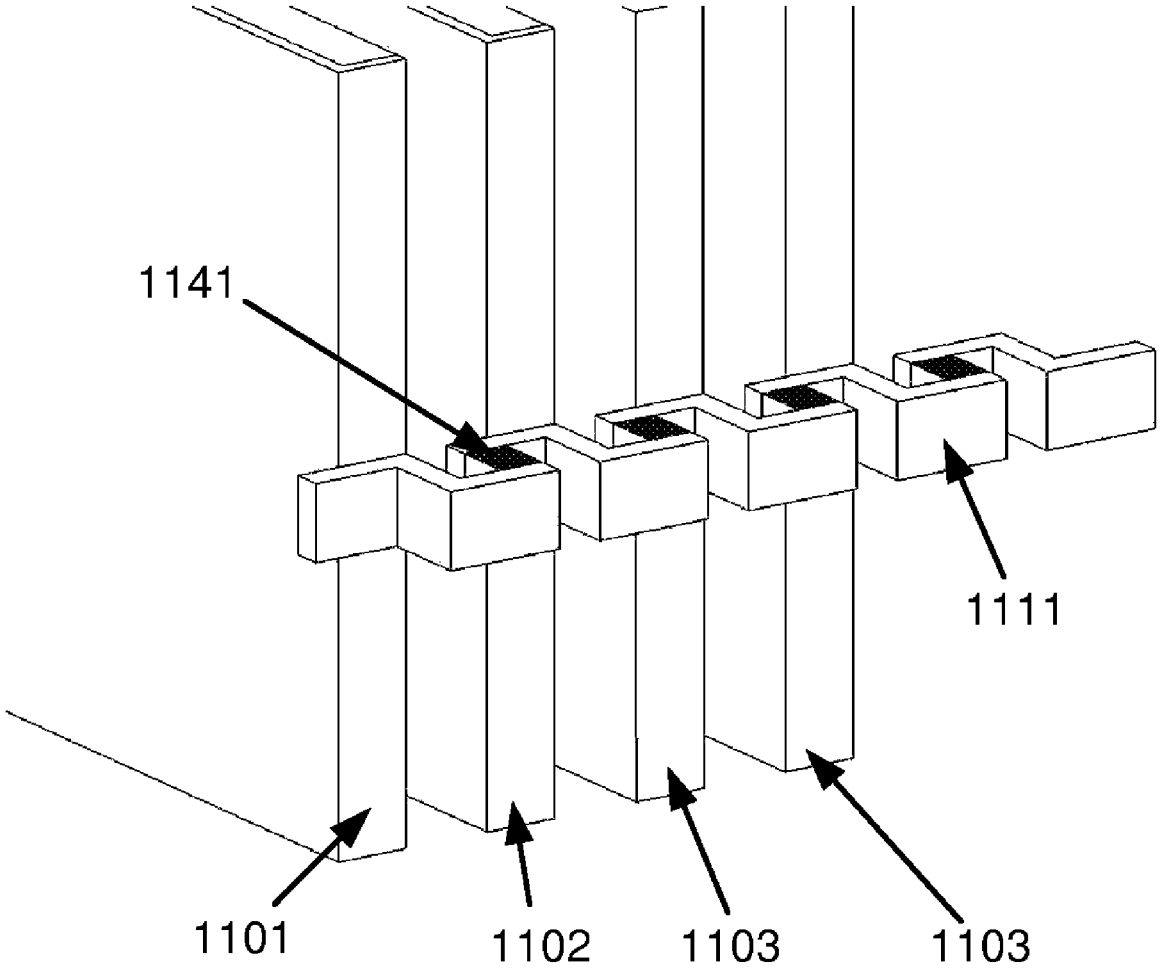
FIG. 11 illustrates alternating power and ground conductors with sandwiched material of high dielectric constant placed between pairs of power and ground conductors for use in a modified connector utilizing aspects of the present invention.

FIG. 11 illustrates the use of an interlocking strip 1111 of decoupling capacitors (e.g., 1141) that fit in (lock into) gaps between adjacent lengthwise extending structures (e.g., 1101-1103) having alternating power and ground voltage reference conductors. Thus, each decoupling capacitor provides an alternating current path between adjacent power and ground voltage reference conductors. A similar interlocking strip may be used on the opposite (or other) sides of the lengthwise extending structures.

Although the various aspects of the present invention have been described with respect to a preferred embodiment, it will be understood that the invention is entitled to full protection within the full scope of the appended claims.

We claim:

1. In a connector having first and second ends, a plurality of signal conductors extending between and coupled to the first and second ends so as to electrically communicate data signals between the first and second ends, and a plurality of voltage reference conductors extending between and coupled to the first and second ends so as to electrically communicate a voltage reference between the first and second ends, wherein a distance between the first and second ends is approximately an integer multiple of one-half of a wavelength of a frequency of the data signals, the improvement comprising:

at least one conductive element attached to the plurality of voltage reference conductors between the first and second ends so as to shift a resonant frequency of the connector beyond a frequency of the data signals electrically communicated by the connector.

2. The connector according to claim 1, wherein the plurality of voltage reference conductors include pairs of power and ground conductors and the at least one conductive element coupling each pair is a capacitor.

3. The connector according to claim 1, wherein the plurality of voltage reference conductors is a plurality of power conductors.

4. The connector according to claim 1, wherein the plurality of voltage reference conductors is a plurality of ground conductors.

5. The connector according to claim 1, wherein the plurality of voltage reference conductors each have a same voltage reference level and one of the at least one conductive elements is attached to each of the plurality of voltage reference conductors midway between the first and second ends.

6. The connector according to claim 5, wherein the plurality of voltage reference conductors each have a same voltage reference level and the at least one conductive element is a plurality of conductive elements attached to the plurality of voltage reference conductors at spaced apart intervals between the first and second ends.

7. A method for modifying a connector so as to shift its resonant frequency beyond an operating frequency range of data signals electrically communicated by the connector, wherein a distance between opposing ends of the connector is approximately an integer multiple of one-half of a wavelength of a frequency of the data signals, the method comprising:

electrically coupling together a plurality of voltage reference conductors at one or more points between the opposing ends of the connector.

8. The method according to claim 7, wherein the plurality of voltage reference conductors is a plurality of power conductors.

9. The method according to claim 7, wherein the plurality of voltage reference conductors is a plurality of ground conductors.

10. The method according to claim 7, wherein the electrically coupling together of the plurality of voltage reference conductors comprises:

attaching at least one conductive element to the plurality of voltage reference conductors.

11. The method according to claim 10, wherein the plurality of voltage reference conductors each have a same voltage reference level and the attaching of the at least one conductive element comprises:

attaching a conductive element to each of the plurality of voltage reference conductors at a point midway between the opposing ends of the connector.

12. The method according to claim 10, wherein the plurality of voltage reference conductors each have a same voltage reference level and the attaching of the at least one conductive element comprises:

attaching a plurality of conductive elements to the plurality of voltage reference conductors at spaced apart intervals between the opposing ends of the connector.

13. The method according to claim 10, wherein the plurality of voltage reference conductors include pairs of power and ground conductors and the at least one conductive element coupling each pair is a capacitor.

* * * * *